United States Patent [19]

Heitman

[11] 3,958,347

[45] May 25, 1976

[54] DRAIN DITCH DIGGING ATTACHMENT FOR A BACK-HOE

[76] Inventor: Leroy Marvin Heitman, 3083 W. Ball Road, Anaheim, Calif. 92804

[22] Filed: July 11, 1974

[21] Appl. No.: 487,546

[52] U.S. Cl. ..... 37/103; 37/118 R; 37/141 R; 37/DIG. 16; 214/145 R

[51] Int. Cl.[2] ..... E02F 3/40

[58] Field of Search ..... 172/13, 377; 37/103, 37/98, 118 R, 118 A, 117 S, 141 R, 195, DIG. 16, 80 A; 214/145

[56] References Cited

UNITED STATES PATENTS

| | | | |
|---|---|---|---|
| 2,480,656 | 8/1949 | Jenne | 37/141 |
| 2,972,425 | 2/1961 | Anderson et al. | 37/103 X |
| 2,979,838 | 4/1961 | Raymond et al. | 37/97 |
| 3,000,120 | 9/1961 | Larve et al. | 37/103 |
| 3,065,801 | 11/1962 | Wood | 172/13 |
| 3,526,047 | 9/1970 | Roessler et al. | 37/98 |
| 3,792,539 | 2/1974 | Clark | 37/103 X |

*Primary Examiner*—Clifford D. Crowder
*Attorney, Agent, or Firm*—Harvey C. Nienow

[57] ABSTRACT

A drain ditch digging attachment which is used with a back-hoe and which is provided with a generally V-shaped bucket for removing ground to form an elongated drainage ditch down or along a slope. The attachment has a long transverse reinforcing bar across the bucket and extending beyond the opposite ends thereof, such extensions having ground cutting and moving members such that the attachment not only digs the ditch but also forms the edges or sides of the ditch in one single pass of the attachment without the need for additional manual labor.

3 Claims, 9 Drawing Figures

FIG. 1
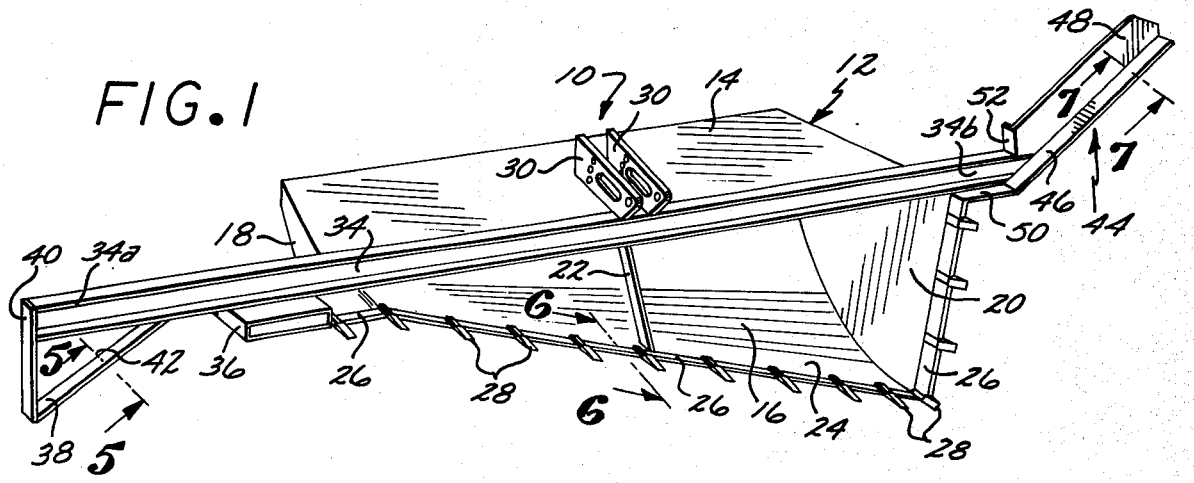
FIG. 2
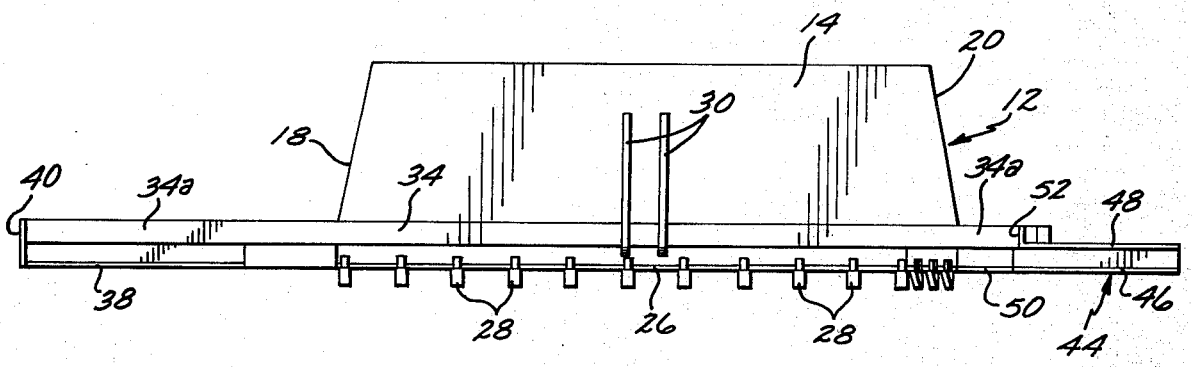
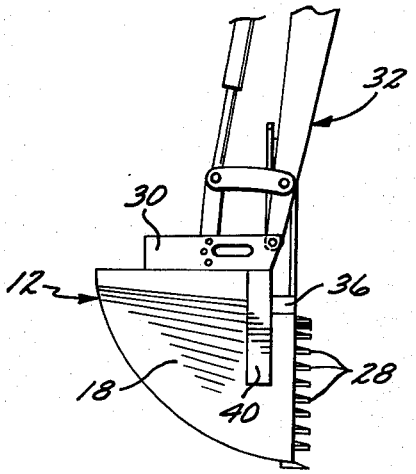
FIG. 3
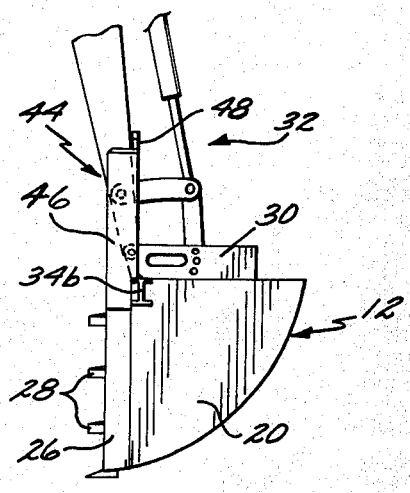
FIG. 4

DRAIN DITCH DIGGING ATTACHMENT FOR A BACK-HOE

The present invention relates generally to drain ditch digging attachments, and more particularly to such attachments as are adapted to be mounted on a back-hoe.

In order to control soil erosion on hillsides and the like, it is necessary to provide drain ditches both up the hill and laterally with respect thereto. Such drainage ditches are intended to carry the surface water down the side of the hill, and therefore such ditches are usually provided with a cementitious wall such as concrete, gunite or the like.

Due to the hillside nature of the ground, the formation of such ditches before the pouring of the concrete or shooting of the gunite has required considerable hand labor in forming or finishing the ditches. As is well realized, such hand labor is extremely expensive and somewhat slow. It has long been an objective of many individuals in the land grading or ditching business to provide automatic machinery for cutting or digging such ditches to eliminate the high cost labor and to speed up the process. However all prior attempts have resulted in failure to eliminate such hand labor due to the continual need for reshaping portions of the ditch.

It is an object of the present invention to provide a ditch digging attachment for a backhoe which virtually eliminates the need for manual labor in the making of drain ditches.

Another object of the present invention is to provide a ditch digging attachment as characterized above wherein extensions are provided on the digging bucket to shape and grade the surface ground adjacent the ditch.

An even further object of the present invention is to provide a ditch digging attachment as characterized above which includes a bucket having teeth for digging into the ground surface to remove the soil, but wherein the extensions do not remove soil but rather merely reshape the edges of the ditch.

Another object of the present invention is to provide a ditch digging attachment as characterized above which is simple and inexpensive to manufacture and which is rugged and dependable in operation.

The novel features which I consider characteristic of my invention are set forth with particularity in the appended claims.

The device itself, however, both as to its organization and mode of operation, together with additional objects and advantages thereof, will best be understood from the following description of specific embodiments when read in connection with the accompanying drawings, in which:

FIG. 1 is a perspective view of a ditch digging attachment according to the present invention;

FIG. 2 is a top plan view of the attachment of FIG. 1;

FIG. 3 is a fragmentary side elevational view of such attachment, connected to a back-hoe;

FIG. 4 is a second fragmentary side elevational view of such attachment;

Like reference characters indicate corresponding parts throughout the several views of the drawings.

Figure 8:
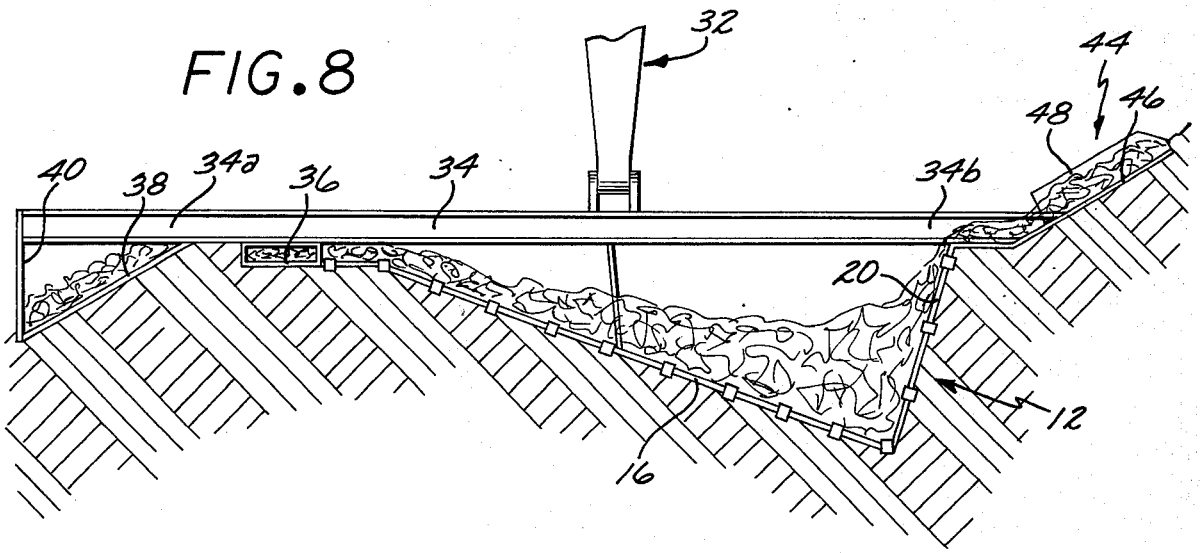
FIG. 8 is a sectional view through a portion of ground surface showing the attachment in operation.

Referring to FIG. 1 of the drawings, there is shown therein an attachment 10 which, as shown more particularly in FIGS. 3, 4, and 8, is to be attached to a back-hoe.

Attachment 10 comprises a main portion 12 in the form of a bucket having a top wall 14, a bottom wall 16, and a pair of opposite side walls 18, and 20. Bottom wall 16 is arcuately shaped to constitute both the bottom and rear wall of bucket 12, and to provide an additional function, as will be hereinafter described. A reinforcing brace or support 22 extends between the top and bottom walls of main portion 12 to afford additional strength and rigidity.

The aforedescribed walls of main portion 12 may be formed of any appropriate, strong material such as steel or the like, and they are preferably firmly fastened together in the configuration shown as by welding, brazing, sodering or the like. The support 22 is also preferably welded in place to provide a compact unitary structure. Such construction, of course, provides a bucket 12 having an opening 24. For purposes of reinforcement for both wear and rigidity, reinforcing edges 26 may, if desired, be firmly secured to the edge of the various side walls. In this way, a rigid and wear-resistant edge of the bucket 12 is provided.

Figure 6:
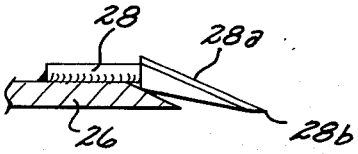
FIG. 6 is a fragmentary sectional view taken substantially along line 6—6 of FIG. 1.

A plurality of digging teeth 28 is provided along the edge of bottom wall 16 and a side wall 20 to enable the bucket to firmly dig into the ground as will hereinafter become apparent. Each of such teeth 28, as shown most particularly is FIG. 6 of the drawings, is tapered as at **28*a* to provide a sharp cutting edge 28*b* which can pierce the ground. To prevent disturbing the sub-grade following forming of the ditch, each tooth 28 is attached to the wall of the bucket within the bucket. Thus, although the teeth 28** make the initial contact with the ground, the bottom and side walls of the bucket make the final contact and thus determine the sub-grade or final shape of the ditch.

Firmly secured to the top wall 14 of bucket 12 is a pair of spaced bracket members 30 which, as shown most particularly in FIGS. 3, 4, and 8 of the drawings, is used to connect the attachment 10 to the arm or boom mechanism of a backhoe. Suitably fastening pins are employed to complete the connection therebetween, and the backhoe boom mechanism 32 is such as to enable the bucket to be drawn on a straight line through the ground without tilting or pivoting.

Firmly secured to the bucket 12 and extending thereacross is a reinforcing bar or I-beam 34 of such length as to extend beyond the opposite sides of bucket 12 as shown at **34*a* and 34*b*. A box section 36 is secured to the underside of reinforcing member 34, adjacent the side wall 18 of bucket 12. Such box section 36** is formed with four side walls, and is open, front and rear. Such side walls are tapered to provide relatively sharp forward cutting edges to cut a sharp angle in the ground, as will hereinafter become more apparent.

A pair of shaping members 38 and 40 are firmly welded to the end of extension **34*a* in a generally V-shape as shown in FIGS. 1 and 8 of the drawings, to provide means for cutting, working, and smoothing the ground surface on one side of the ditch, as will hereinafter be explained in greater detail. Such members 38 and 40 provide a through opening 42** through which ground material is permitted to pass as it is cut, shaped and smoothed into place.

The extension 34*b* of reinforcing member 34 is provided with a cutting and smoothing member 44 which comprises a cutting member 46 and a plate 48. The members 46 and 48 are welded together, as shown, and are welded to the extension 34*b* of reinforcing member 34, and an intermediate cutting member 50 is provided between the cutting member 46 and the reinforcing edge 26 of side wall 20 of bucket 12. Also, plate 48 is reinforced and braced by a support member 52 all of which are firmly welded to the reinforcing member extension 34*b* at an angle as shown.

Figure 5:
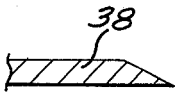
FIG. 5 is a fragmentary sectional view taken substantially along line 5—5 of FIG. 1.
Figure 7:
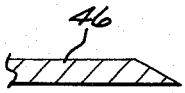
FIG. 7 is a fragmentary sectional view taken substantially along line 7—7 of FIG. 1.

As shown most particularly in FIGS. 5 and 7 of the drawings, the various cutting members 38, 40, 46, and 50 are formed with tapered edges to provide a cutting edge for neatly and effectively digging through the ground surface.

Figure 9:
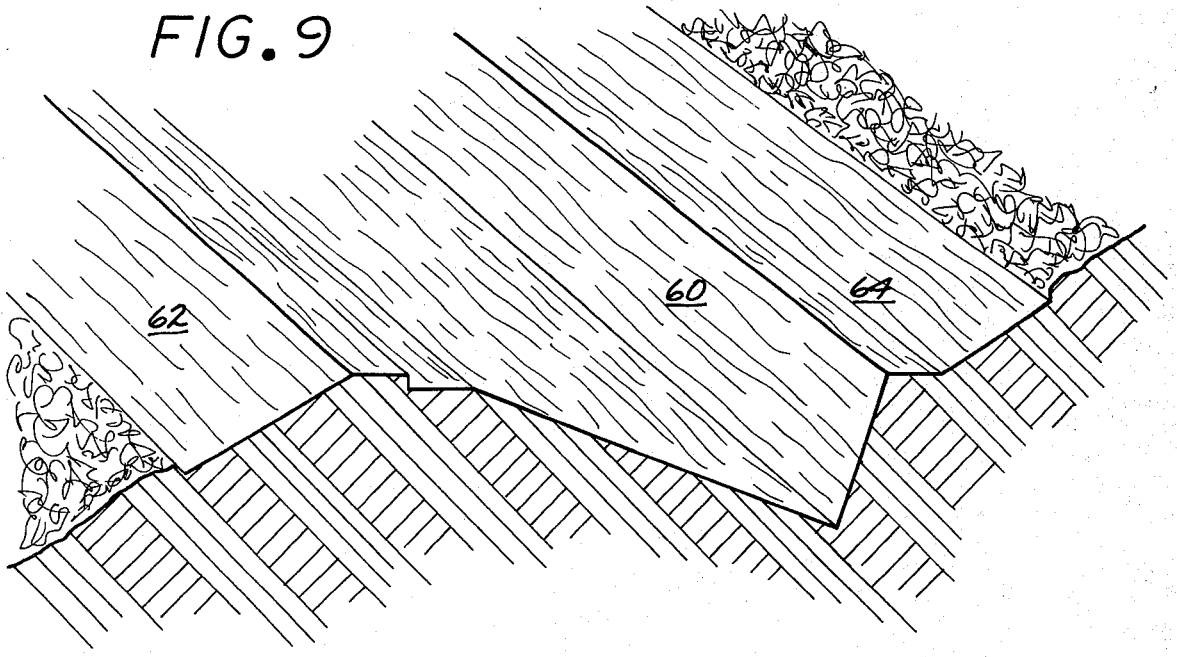
FIG. 9 is a perspective view showing the ditch after formation by the subject attachment.

With the subject attachment 10 connected to the boom mechanism 32 of a back-hoe, (not shown), the attachment is moved through the ground when the boom mechanism of the back-hoe is extended and then drawn toward the back-hoe itself. In this regard, the subject attachment, although usable in forming a drain ditch down the side of a hill is most suitable for cutting lateral drain ditches, at a constant elevation along the side of the hill. In any event, as the attachment 10 is drawn through the ground, as shown most particularly in FIGS. 8 and 9 of the drawings, the ground is scooped up by the bucket 12 through the opening 24 therein. At the same time, and with the same scooping motion, the members 38 and 40 at the extension 34*a* of reinforcing member 34, and the members 46 and 50 at the opposite extension thereof cut into the ground material thereby doing several things. The hard compacted soil is cut to establish the proper grade level, and the ground is loosened and smoothed to that particular grade.

In the forming of the drain ditch, the bucket 12 scoops out the dirt or ground for the primary portion of the ditch, and the cutting and smoothing members attached to the extensions of reinforcing member 34 work and shape the sides of the ditch, where the ditch joins the remaining terrain of the hillside. Thus, with a single pass of the subject ditch digging attachment, not only is the ditch itself dug and provided as shown at 60 in FIG. 9 of the drawings, but also the several shoulders 62 and 64 on either side of said ditch are formed to keep the ditch 60 clean and to establish the proper grade level. This is accomplished without the need for any additional manual labor, and thereafter the reinforcing steel as well as the concrete or gunite can be added to the ditch to make the necessary concrete-lined drainage ditch. The shoulders 62 and 64 can be covered in any appropriate way as with cementitious material or appropriate plantings to join with the remaining terrain.

Due to the arcuate nature of the bottom wall 16 of bucket 12, as shown most clearly in FIGS. 3 and 4 of the drawings, as the attachment 10 is drawn forward by the back-hoe, the ditch 60 is not disturbed after it is initially cut with the forward edge of the bucket 12. Although the backhoe mechanism is constructed to keep the bucket in proper orientation throughout its travel through the ground, the arcuate bottom wall 60 further insures that the ditch configuration will not be harmed by any possible slight pivotal movement of the bucket during such travel.

It is thus seen that the present invention provides a ditch digging attachment for backhoes and the like which is operable to cut a drainage ditch and shape the sides of the ditch in one single pass without the need for manual labor.

Although I have shown and described certain specific embodiments of my invention, I am well aware that many modifications thereof are possible.

I claim:

1. A drain ditch digging attachment for a back-hoe comprising in combination, a main body having a flat top wall, opposite side walls, and an arcuate bottom wall connected to the lower edges of the side walls and to the back edge of the top wall to form an open-front bucket, one of the side walls being slightly inclined to the vertical and much larger than the other side wall, with its leading edge and that of the bottom wall being straight and in alignment, the bottom wall and its leading edge being inclined upwardly from its juncture with the larger side wall, a laterally extending horizontal reinforcing member disposed across and integrally connected to the top of the bucket and which extends parallel to the leading edges of the bucket and outwardly beyond the side walls such that it would be above the ditch formed by the bucket, a cutting and smoothing member disposed adjacent the larger side wall which is connected to one end of the reinforcing member and extends outwardly and upwardly in alignment with the leading edge of the side wall, the opposite end of the reinforcing member extending outwardly beyond the opposite side wall for a distance approximately half the width of the bucket and having a ground shaping member depending therefrom, means connected to the reinforcing member and to the top wall for providing a connection to a back-hoe.

2. The drain ditch digging attachment as set forth in claim 1, wherein, the leading edge of the bottom wall and the leading edge of the larger side wall have a plurality of digging teeth thereon.

3. The drain ditch digging attachment as set forth in claim 1, wherein, a horizontally extending cutting member is disposed between and on a line with the leading edges of the larger side wall and the cutting and smoothing member.

* * * * *